US006904734B2

(12) United States Patent
Hardy

(10) Patent No.: US 6,904,734 B2
(45) Date of Patent: Jun. 14, 2005

(54) METHOD FOR PACKING A PRIMARY SHIPPING CASE

(75) Inventor: Gregory J. Hardy, Middleton, MA (US)

(73) Assignee: Osram Sylvania Inc., Danvers, MA (US)

( * ) Notice: Subject to any disclaimer, the term of this patent is extended or adjusted under 35 U.S.C. 154(b) by 130 days.

(21) Appl. No.: 10/302,068

(22) Filed: Nov. 22, 2002

(65) Prior Publication Data

US 2003/0057128 A1 Mar. 27, 2003

Related U.S. Application Data

(62) Division of application No. 09/680,815, filed on Oct. 5, 2000, now Pat. No. 6,530,480.

(60) Provisional application No. 60/157,953, filed on Oct. 6, 1999.

(51) Int. Cl.[7] ..... B65B 23/22; B65B 23/00

(52) U.S. Cl. ..... 53/399; 53/397; 53/449; 53/462; 53/472

(58) Field of Search ..... 53/472, 397, 399, 53/449, 462, 49, 137.2, 582, 173, 176, 139.5, 139.6, 139.7

(56) References Cited

U.S. PATENT DOCUMENTS

| | | | | |
|---|---|---|---|---|
| 1,601,547 A | | 9/1926 | Wofford | |
| 1,768,203 A | | 6/1930 | Kole | |
| 1,849,065 A | | 3/1932 | Biederman | |
| 2,173,871 A | | 9/1939 | Zalkind | |
| 2,808,193 A | | 10/1957 | Michalka | |
| 2,979,246 A | | 4/1961 | Liebeskind | |
| 3,070,281 A | | 12/1962 | Durkin et al. | |
| 3,266,705 A | | 8/1966 | Wood | |
| 3,283,988 A | | 11/1966 | Hardigg | |
| 3,344,973 A | | 10/1967 | Studen | |
| 3,476,235 A | | 11/1969 | Mills et al. | |
| 3,581,883 A | | 6/1971 | Whitney | |
| 3,660,958 A | | 5/1972 | Garrison | |
| 3,817,371 A | | 6/1974 | Gatter | |
| 3,867,874 A | | 2/1975 | O'Neil | |
| 4,241,829 A | | 12/1980 | Hardy | |
| 4,282,279 A | | 8/1981 | Strickland | |
| 4,324,111 A | * | 4/1982 | Edwards | 53/410 |
| 4,339,039 A | | 7/1982 | Mykleby | |
| 4,564,407 A | * | 1/1986 | Tsuruta | 53/472 |
| 4,773,534 A | | 9/1988 | DeHeras et al. | |
| 4,792,046 A | | 12/1988 | Taylor | |
| 4,883,179 A | | 11/1989 | Dionne | |
| 4,953,705 A | | 9/1990 | Evamy | |
| 5,040,696 A | | 8/1991 | Liebel | |
| 5,156,901 A | | 10/1992 | Tanaka | |
| 5,413,221 A | | 5/1995 | Mizuno | |
| 5,499,486 A | | 3/1996 | Kimoto et al. | |
| 5,624,035 A | | 4/1997 | Kim | |
| 6,038,834 A | | 3/2000 | Haley | |

FOREIGN PATENT DOCUMENTS

| | | | | |
|---|---|---|---|---|
| DE | 31 25 350 A1 | | 1/1983 | |
| FR | 2112735 | | 6/1972 | |
| JP | 05051020 A | * | 3/1993 | B65B/55/20 |

OTHER PUBLICATIONS

Interior Design Fluorescent Lamps, Sylvania Catalog, 1988, one page.

* cited by examiner

*Primary Examiner*—Stephen F. Gerrity
(74) *Attorney, Agent, or Firm*—Carlo S. Bessone

(57) ABSTRACT

An overpack carton for packing a primary shipping case includes a packing strap having interconnected side panels and a latching panel, one or more cushion strips secured to the side panels, and latching elements for latching the packing strap around at least a portion of the primary shipping case. A method for packing a primary shipping case includes steps of providing a cushioned packing strap having latching elements, wrapping the packing strap around at least a portion of the primary shipping case and interengaging the latching elements.

27 Claims, 9 Drawing Sheets

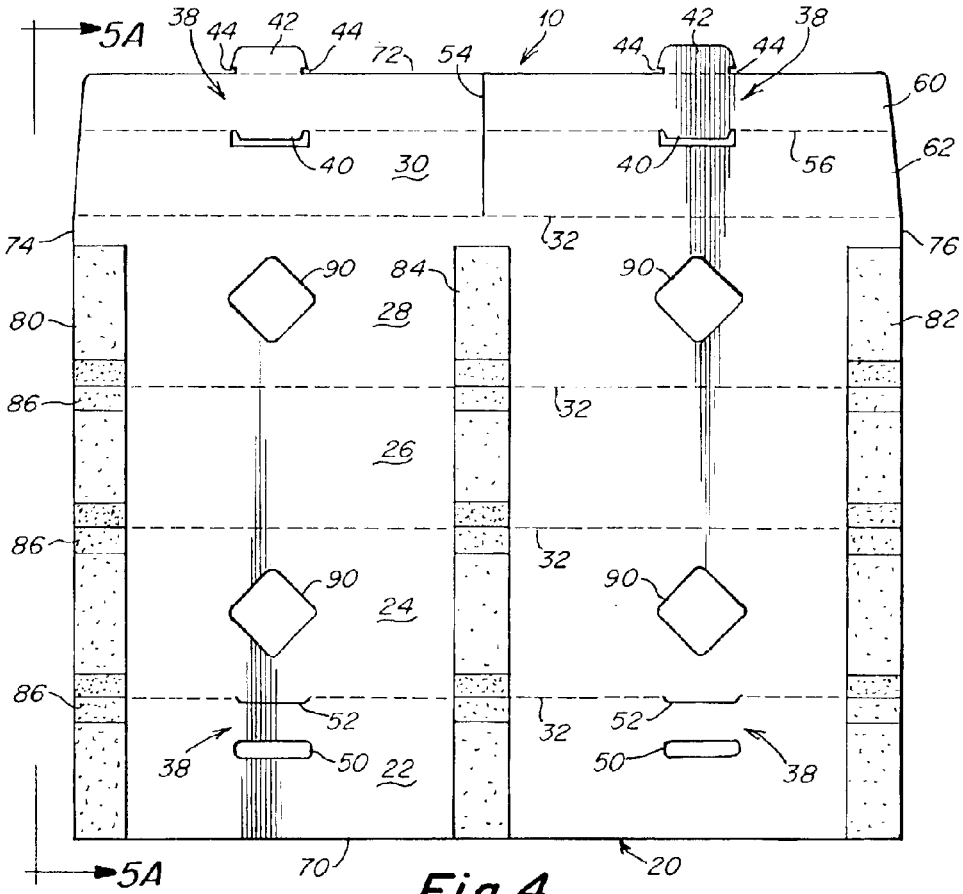
Fig. 4
Fig. 5A
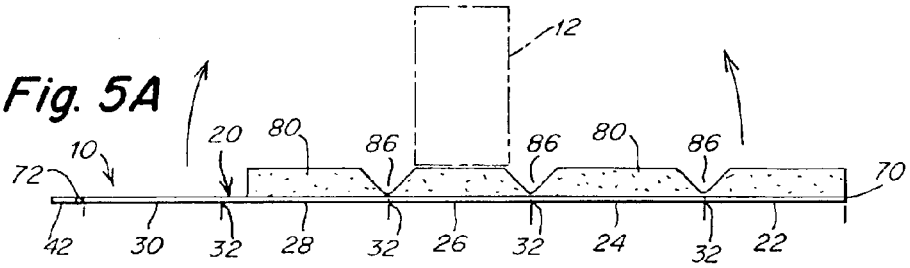
Fig. 5B
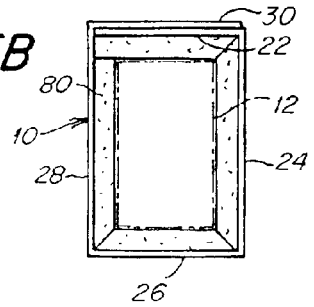

METHOD FOR PACKING A PRIMARY SHIPPING CASE

CROSS-REFERENCE TO RELATED APPLICATIONS

This application is a division of U.S. patent application Ser. No. 09/680,815, filed Oct. 5, 2000, now U.S. Pat. No. 6,530,480, and which claims the benefit of U.S. provisional patent application Ser. No. 60/157,953, filed Oct. 6, 1999.

FIELD OF THE INVENTION

This invention relates to protective shipping cartons and, more particularly, to overpack cartons that are used for packing primary shipping cartons and which provide a high degree of protection to the primary shipping case, are easy to use and are low in cost.

BACKGROUND OF THE INVENTION

Product cartons, and in particular lamp product cartons, have been commonly shipped in large quantities, typically pallet loads. Pallets include wooden bases and exterior wrapping that provide good support. Pallets are too large to be moved by individuals and are therefore moved slowly and in controlled ways by machines.

Current marketing trends indicate that smaller product quantities are frequently ordered. The smaller product quantities are shipped by package carriers and are handled manually. Such shipping frequently results in damaged packages. Lamps are fragile, and broken lamps are unacceptable to customers. To protect the smaller quantities held in a primary shipping case or package, the primary shipping case is enclosed in an overpack carton. Prior art overpack cartons have included a full exterior carton with Styrofoam, polystyrene or cardboard cushions positioned between the primary shipping case and the overpack carton. Frequently, it is difficult to slide the primary shipping case into the overpack carton while retaining the cushions in place. In addition, no overpack carton has been certified by package shippers. Since the packaging is not certified, broken lamp shipments are returned to the vendor at the vendor's expense.

A number of prior art packaging techniques are known. One approach uses a large exterior carton with Styrofoam "popcorn", wadded newspapers or similar cushioning material between the product package and the exterior carton. This method is not fully reliable, since the inner product package may be positioned too close to an exterior wall, or insufficient filler material may be used to fill the intermediate space. This approach is also costly, since a large exterior carton is used, and an excessive amount of cushioning material is used. The labor associated with this packaging technique is also substantial.

A second prior art packaging technique uses a large exterior carton and eight Styrofoam corner cushions. The inner package is then positioned in the exterior carton with the inner package walls and the outer carton walls parallel to each other. Less fill material is used, and the packing process is faster. This approach has been used to pack inner packages of fluorescent lamps. The Styrofoam cushions do not provide good shock resistance, and breakage of the product may occur. The exterior carton is relatively large, and the time for filling and sealing is substantial. This approach has not been certified by package shippers for insurance purposes.

A third approach uses an exterior carton into which the inner package is placed, with the inner package walls rotated at 45° relative to the exterior carton walls. Triangular folded cardboard cushions are then inserted between the inner package and a corner of the exterior carton. While four triangular cardboard cushions may be used, in actual practice two are usually positioned on opposite sides of the inner package. This method has also been used to pack inner packages of fluorescent lamps. The method requires an exterior carton that is at least 40% larger than the inner package. Material use is high, and packing is labor-intensive, leading to an expensive overall package. This method has not been certified by package shippers for insurance purposes.

Cushioned packaging devices have been disclosed, for example, in U.S. Pat. No. 4,339,039, issued Jul. 13, 1982 to Mykleby; U.S. Pat. No. 5,040,696, issued Aug. 20, 1991 to Liebel; U.S. Pat. No. 1,601,547, issued Sep. 28, 1926 to Wofford; U.S. Pat. No. 5,624,035, issued Apr. 29, 1997 to Kim; and U.S. Pat. No. 3,266,705, issued Aug. 16, 1966 to Wood. All of the known prior art exterior packaging techniques have had one or more disadvantages, including, but not limited to, a failure to adequately protect the inner package, excessively large size and high cost of materials and/or labor.

Accordingly, there is a need for improved overpack cartons and methods of packing a primary shipping case.

SUMMARY OF THE INVENTION

According to a first aspect of the invention, an overpack device is provided for packing a primary shipping case. The overpack device comprises a packing strap including a plurality of panels, at least one cushion secured to the packing strap, and latching elements on the packing strap for latching the packing strap around at least a portion of the primary shipping case with the at least one cushion facing the primary shipping case.

According to another aspect of the invention, an overpack carton is provided for packing a primary shipping case. The overpack carton comprises a packing strap including interconnected first, second, third and fourth side panels, and a latching panel connected to the fourth side panel, at least two cushion strips secured to the first, second, third and fourth side panels, and latching elements on the first side panel and the latch panel for latching the packing strap around at least a portion of the primary shipping case.

According to a further aspect of the invention, a method is provided for packing a primary shipping case. The method comprises the steps of providing a cushioned packing strap having latching elements, wrapping the packing strap around at least part of the primary shipping case, and interengaging the latching elements.

According to another aspect of the invention, an overpack carton is provided for packing a primary shipping case. The overpack carton comprises a packing strap including a plurality of interconnected panels, at least one cushion secured to the packing strap, and at least one closure device for closing the packing strap around at least part of the primary shipping case with the cushion facing the primary shipping case. The closure device may comprise tape, one or more bands, or latching elements on the packing strap.

BRIEF DESCRIPTION OF THE DRAWINGS

For a better understanding of the present invention, reference is made to the accompanying drawings, which are incorporated herein by reference and in which:

FIG. 4 is a top plan view of the unfolded overpack carton, showing a first configuration of the cushion strips;

FIG. 5A is a schematic end view of the unfolded overpack carton as seen along arrows 5A—5A of FIG. 4;

FIG. 5B is a schematic end view of the overpack carton wrapped around the primary shipping case;

DETAILED DESCRIPTION

Figure 1:
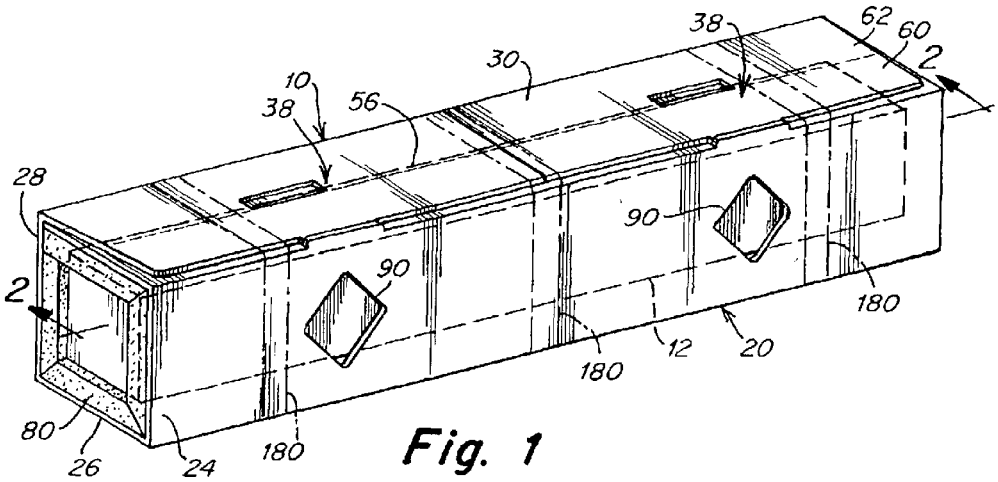
FIG. 1 is a perspective view of a first overpack configuration utilizing a full length overpack carton secured around a primary shipping case.

A first overpack configuration utilizing a full-length overpack carton is illustrated in FIGS. 1–5B, where like elements have the same reference numerals. An overpack carton 10 is secured around a primary shipping case 12. In the embodiment of FIGS. 1–5B, the primary shipping case 12 and the overpack carton 10 have an elongated rectangular configuration, such as may be utilized for packing fluorescent lamps. However, the primary shipping case 12 may have any form factor and size and may contain any product. The overpack carton 10 is shown wrapped around primary shipping case 12 in FIGS. 1, 2, 3 and 5B, and is shown unfolded in FIGS. 4 and 5A.

As best shown in FIG. 5A, overpack carton 10 includes a packing strap 20, which may be folding, nonfolding or corrugated paperboard for example. Packing strap 20 includes a first side panel 22, a second side panel 24, a third side panel 26, a fourth side panel 28 and a latching panel 30. Adjacent panels are interconnected along fold lines 32. Packing strap 20 has a first end 70, a second end 72 and sides 74 and 76. In the embodiment of FIGS. 1–5B, packing strap 20 preferably has a width along fold lines 52 that is somewhat greater than the length of primary shipping case 12 and a length that permits the overpack carton to be wrapped around primary shipping case 12 with latching panel 30 overlapping side panel 22, as shown in FIG. 3.

The overpack carton 10 further includes latching elements 38 for latching packing strap 20 around the primary shipping case 12. In the embodiment of FIGS. 1–5B, the latching elements are integrally formed in packing strap 20. The latching elements include first tabs 40 and second tabs 42 formed in latching panel 30. First slots 50 are formed in first side panel 22, and second slots 52 are formed along the fold line 32 between first side panel 22 and second side panel 24. Latching panel 30 is divided along a fold line 56 into a lever panel 60 and a base panel 62. First tabs 40 are formed in latching panel 30 along fold line 56. When latching panel 30 is folded along fold line 56, tabs 40 extend outwardly, as best shown in FIG. 10B. Second tabs 42 are formed at the edge of latching panel 30. Tabs 42 may include cuts 44 which permit tabs 42 to be locked into slots 52. The overpack carton of FIGS. 1–5B includes two complete sets of latching elements because it is relatively long. As shown in FIG. 4, latching panel 30 may be divided along a line 54 into sections to facilitate independent operation of the latching elements. Other embodiments of the overpack carton may include a single set of latching elements or more than two sets of latching elements.

It may be observed that first side panel 22 and latching panel 30 are located at opposite ends of packing strap 20. The first tabs 40 and second tabs 42 are formed in latching panel 30, and first slots 50 and second slots 52 are formed in first side panel 22. When the packing strap 20 is wrapped around primary shipping case 12, first tabs 40 engage first slots 50 and second tabs 42 engage second slots 52 to provide latching of the overpack carton as described below.

Figure 6A:
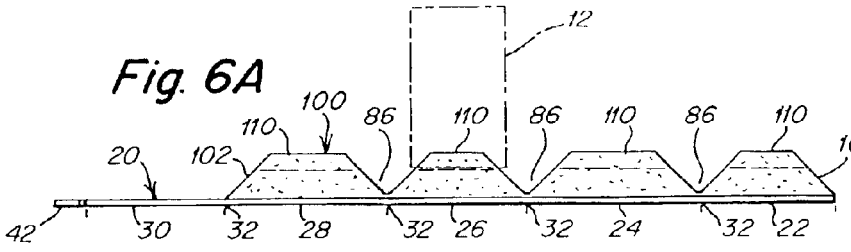
FIG. 6A is a schematic end view of an unfolded overpack carton, showing a second configuration of the cushion strip with end corners.
Figure 6B:
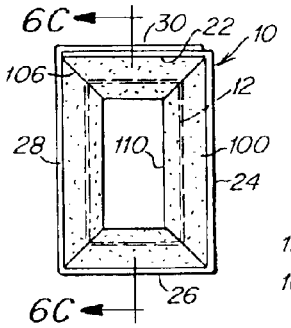
FIG. 6B is a schematic end view of a wrapped primary shipping case, using the second configuration of the cushion strip shown in FIG. 6A.

The overpack carton 10 further includes at least one cushion for protection of primary shipping case 12. Preferably, the overpack carton includes at least one cushion strip. The overpack carton 10 shown in FIGS. 1–5B includes spaced-apart cushion strips 80, 82 and 84 affixed to packing strap 20 by a suitable adhesive. Each of the cushion strips 80, 82 and 84 runs lengthwise along packing strap 80. In particular, cushion strips 80 and 82 are located along opposite sides of packing strap 20, and cushion strip 84 is located along the center of packing strap 20. In the embodiment of FIGS. 1–5B, cushion strips 80, 82 and 84 are provided with notches 86 at locations corresponding to fold lines 32 of packing strap 20. In particular, the apex of each notch 86 is located along one of fold lines 32. The notches 86 may, but are not required to be, 90° notches. The notches 86 effectively divide the cushion strips into segments corresponding to respective side panels of packing strap 20. When the overpack carton 10 is wrapped around the primary shipping case 12, the notches close, as indicated by lines 88 in FIG. 3, to form a continuous cushion strip around primary shipping case 12. As shown in FIGS. 5A and 5B, segments of cushion strips 80, 82 and 84 on side panel 28 are shorter than side panel 28 and have squared off ends. This permits the ends of each cushion strip to abut, as indicated by line 92 in FIG. 3, so as to form a continuous cushion strip when the overpack carton 10 is wrapped around primary shipping case 12. In another configuration, the ends of the cushion strips extend the full length of the side panels and have beveled ends which abut when the overpack carton is wrapped around the primary shipping case, as shown in FIGS. 6A and 6B. The cushion strips 80, 82 and 84 are preferably made of a compressible but resilient foam. One preferred foam material is polyurethane foam. It will be understood that more or fewer cushions strips may be utilized depending on the size of the overpack carton and the required protection of primary shipping case 12.

The packing strap 20 may be provided with optional openings 90 of any desired size or shape which function as hand grips. Because packing strap 20 is spaced from primary shipping case 12 by cushion strips 80, 82 and 84, spaces are provided at openings 90 for gripping overpack carton 10.

Figure 2:
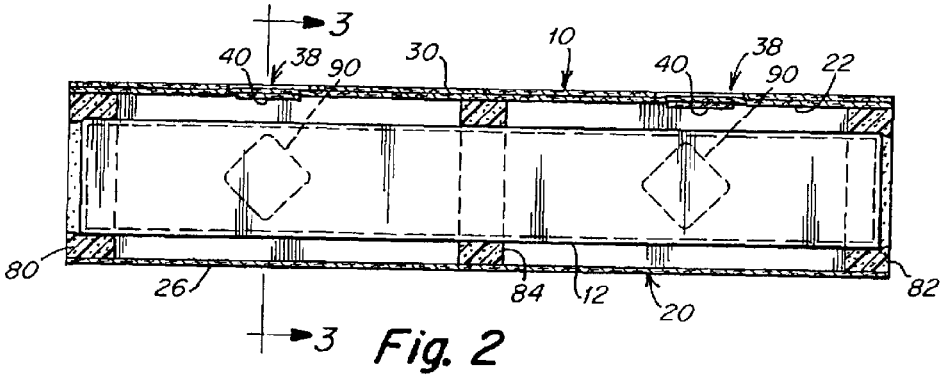
FIG. 2 is a cross-sectional side view of the overpack carton, taken along the line 2—2 of FIG. 1.
Figure 3:
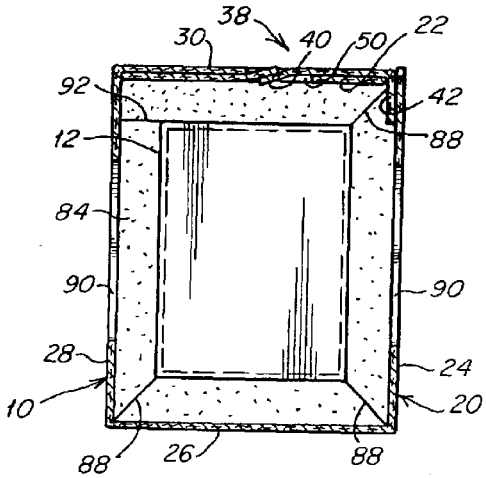
FIG. 3 is a cross-sectional end view of the overpack carton, taken along the line 3—3 of FIG. 2.

The overpack carton 10 is shown wrapped around and latched to primary shipping case 12 in FIGS. 1–3. As shown, packing strap 20 is folded along fold lines 32, and side panels 22, 24, 26 and 28 are wrapped around the sides of primary shipping case 12, with latching panel 30 overlapping first side panel 22. The overlap of latching panel 30 with first side panel 22 permits first tabs 40 to engage first slots 50 and permits second slots 42 to engage second slots 52 for secure latching, as described below. The cushion strips 80, 82 and 84 are preferably somewhat compressed and provide resilient support of primary shipping case 12 within packing strap 20. In addition, cushion strips 80, 82 and 84 cause packing strap 20 to be spaced from primary shipping case 12.

In some cases, the overpack carton 10, including cushion strips 80 and 82, may extend somewhat beyond the end of primary shipping case 12, so that primary shipping case 12 is recessed within overpack carton 10. Thus, although the ends of the overpack carton 10 are open in this embodiment, the edges of the packing strap 20 and the cushion strips 80 and 82 provide protection for the ends of the primary shipping case 12. In other cases, the overpack carton 10 does not extend beyond the end of primary shipping case 12.

Figure 6C:
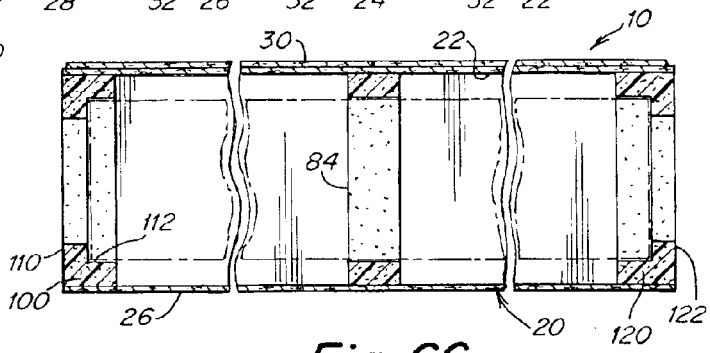
FIG. 6C is a cross-sectional side view of the overpack carton and primary shipping case, taken along line 6C—6C of FIG. 6B.

A second configuration of the cushion strip is shown in FIGS. 6A–6C. Like elements in FIGS. 1–6C have the same reference numerals. A cushion strip 100 is provided with notches 86 at locations corresponding to the fold lines 32 of packing strap 20. In addition, cushion strip 100 is provided with beveled ends 102 and 104 which abut along line 106, as shown in FIG. 6B, when the overpack carton is wrapped around primary shipping case 12. Each of the segments of cushion strip 100 includes a raised edge 110 which defines a step 112, as best shown in FIG. 6C. The raised edge 100 provides additional protection of primary shipping case 12 and prevents shipping case 12 from slipping relative to overpack carton 10. A cushion strip 120 at the opposite end of overpack carton 10 may have a raised edge 122, as shown in FIG. 6C.

Figure 7A:
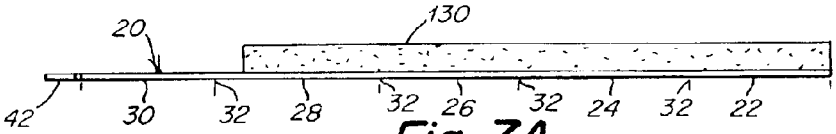
FIG. 7A is a schematic end view of an unfolded overpack carton, showing a third configuration of the cushion strip.
Figure 7B:
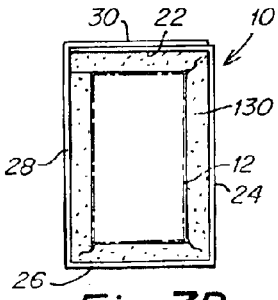
FIG. 7B is a schematic end view of a primary shipping case and overpack carton corresponding to the cushion strip configuration of FIG. 7A.

A third configuration of the cushion strip is shown in FIGS. 7A and 7B. Like elements in FIGS. 1–5B, 7A and 7B have the same reference numerals. A cushion strip 130 is formed without notches and therefore is not divided into segments. Thus, when the packing strap 20 is wrapped around primary shipping case 12, cushion strip 130 is deformed and compressed in regions near the corners of primary shipping case 12, as shown in FIG. 7B.

Figure 8A:
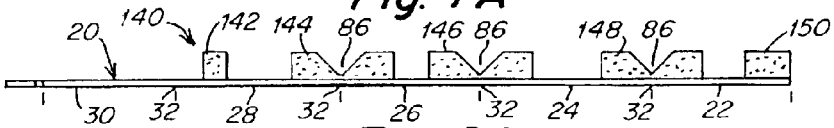
FIG. 8A is a schematic end view of an unfolded overpack carton, showing a fourth configuration of the cushion strip.
Figure 8B:
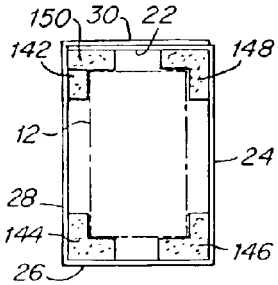
FIG. 8B is a schematic end view of a primary shipping case and overpack carton corresponding to the cushion strip configuration of FIG. 8A.

A fourth configuration of the cushion strip is shown in FIGS. 8A and 8B. Like elements in FIGS. 1–5B, 8A and 8B have the same reference numerals. A cushion strip 140 is formed as a series of spaced-apart segments 142, 144, 146, 148 and 150 positioned on packing strap 20 to engage the corners of primary shipping case 12, as shown in FIG. 8B. Segments 144, 146 and 148 have notches 86 at locations corresponding to fold lines 32 of the packing strap 20. When packing strap 20 is wrapped around primary shipping case 12, notches 86 close such that segments 144, 146 and 148 form corner cushions, as shown in FIG. 8B. In addition, segments 142 and 150 abut at one corner of primary shipping case 12 to form a corner cushion.

Figure 9A:
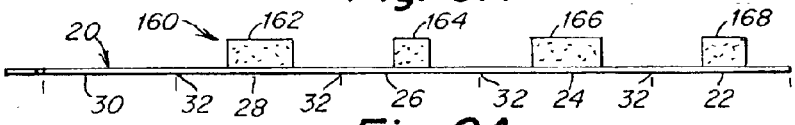
FIG. 9A is a schematic end view of an unfolded overpack carton, showing a fifth configuration of the cushion strip.
Figure 9B:
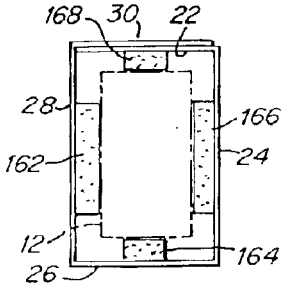
FIG. 9B is a schematic end view of a primary shipping case and overpack carton corresponding to the cushion strip configuration of FIG. 9A.

A fifth configuration of the cushion strip is shown in FIGS. 9A and 9B. Like elements in FIGS. 1–5B, 9A and 9B have the same reference numerals. A cushion strip 160 is configured as a series of spaced-apart segments 162, 164, 166 and 168. Segments 162, 164, 166 and 168 are located on side panels 28, 26, 24 and 22, respectively, of packing strap 20 between fold lines 32. Thus, when packing strap 20 is wrapped around primary shipping case 12, segments 162, 164, 166 and 168 of cushion strip 160 abut the respective sidewalls of primary shipping case 12, as shown in FIG. 9B.

Figure 10A:
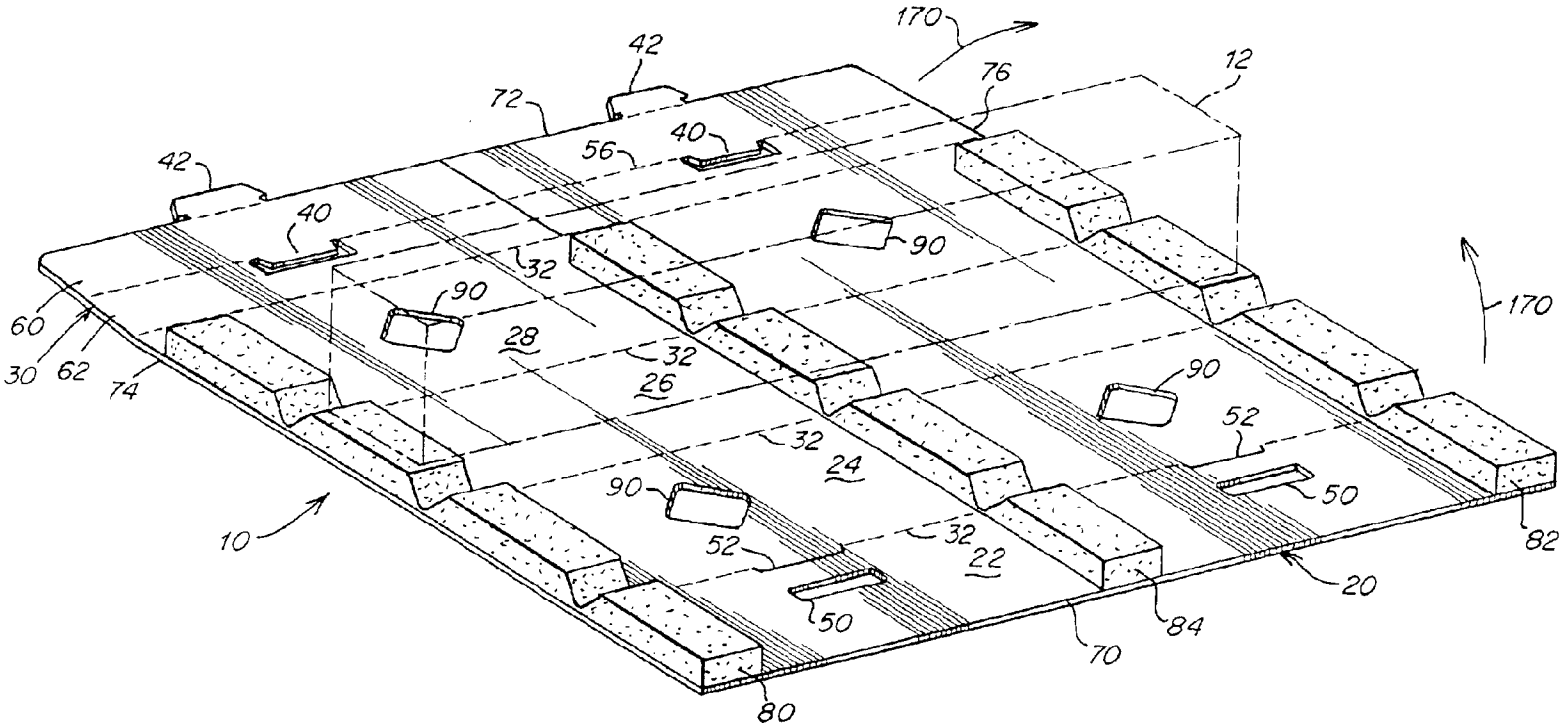
FIG. 10A is a perspective view that illustrates an initial step of a method for packing a primary shipping case using the overpack carton of FIGS. 1–5B.
Figure 10B:
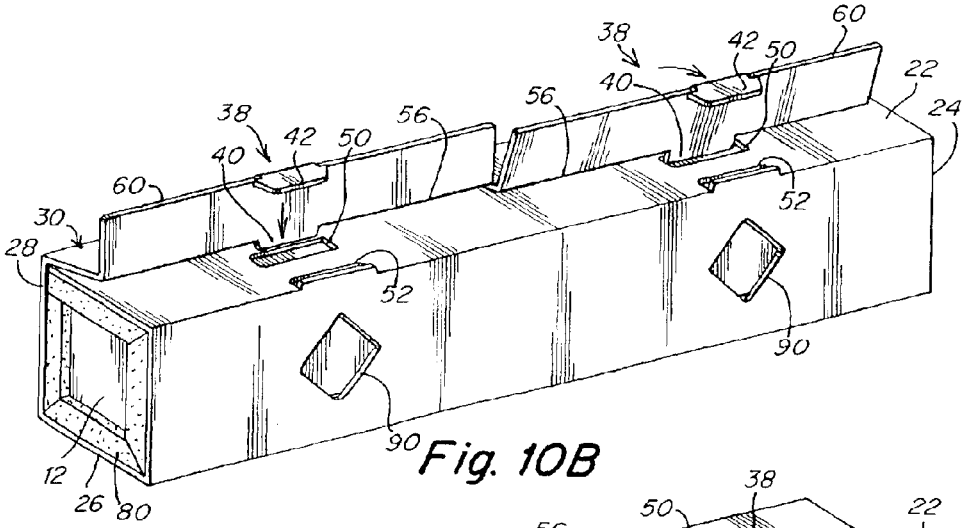
FIG. 10B is a perspective view of the packing method after the overpack carton has been wrapped around the primary shipping case.

A method for packing the primary shipping case 12 using the overpack carton 10 of FIGS. 1–5B is shown in FIGS. 10A–10D. Like elements in FIGS. 1–5B and 10A–10D have the same reference numerals. Initially, the overpack carton 10 is in an unfolded state, as shown in FIG. 10A. Primary shipping case 12 may be positioned on one of the side panels of packing strap 20, such as side panel 26, and packing strap 20 is wrapped around primary shipping case 12 by folding packing strap 20 along fold lines 32. Wrapping of packing strap 20 around primary shipping case 12 is represented in FIG. 10A by arrows 170. Packing strap 20 is positioned such that cushion strips 80, 82 and 84 are on the inside of the overpack carton facing primary shipping case 12. As shown in FIG. 10B, the ends of the packing strap 20 are positioned with first side panel 22 under latching panel 30.

Figure 10C:
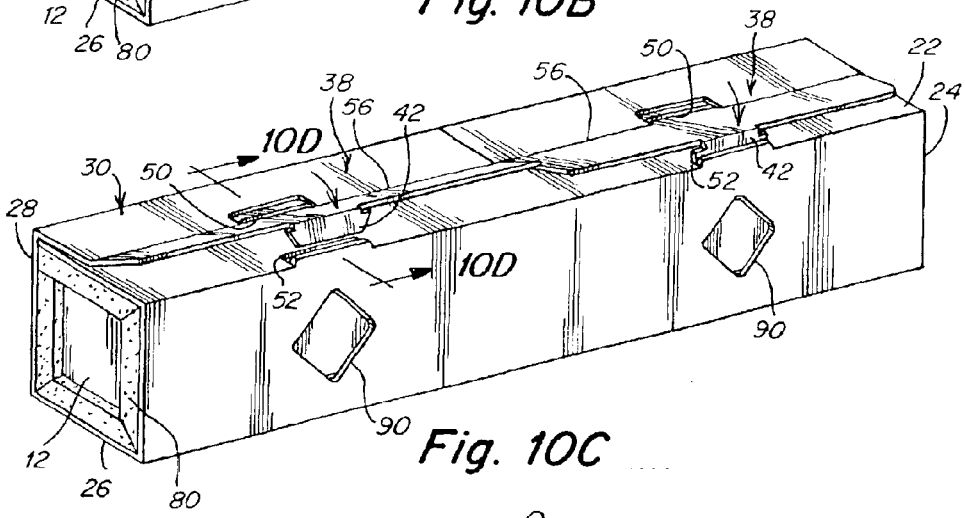
FIG. 10C is a perspective view of the packing method wherein the overpack carton is latched around the primary shipping case.
Figure 10D:
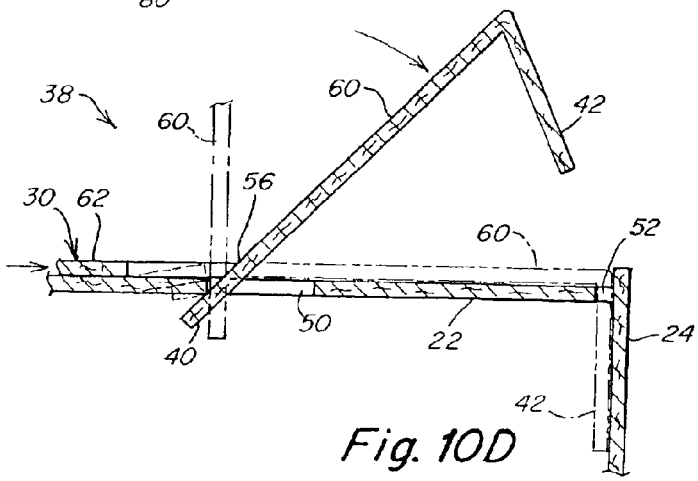
FIG. 10D is a fragmentary cross-sectional view of the latching mechanism, taken along the line 10D—10D of FIG. 10C.
Figure 11:
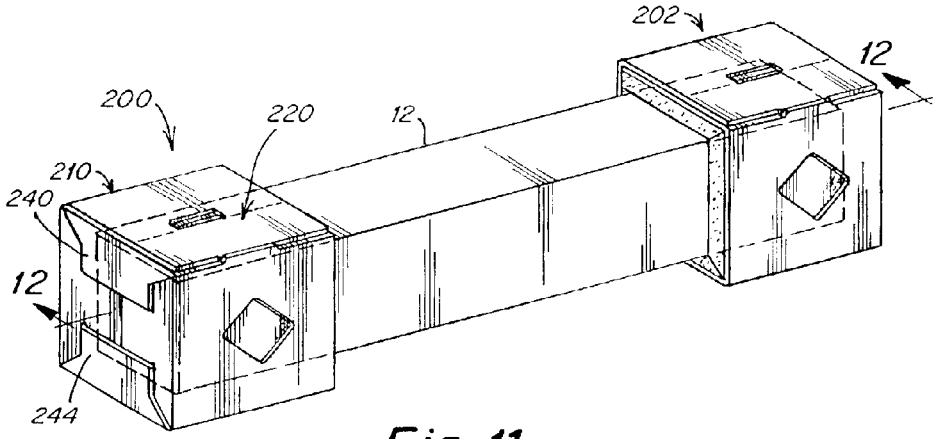
FIG. 11 is a perspective view of a second overpack configuration utilizing two end cap overpack cartons.
Figure 12:
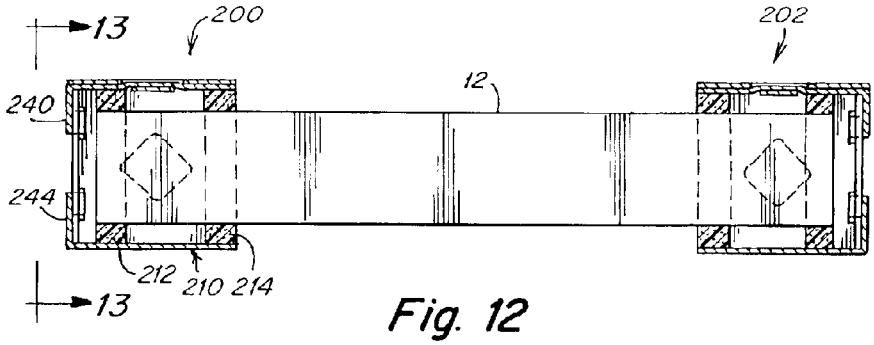
FIG. 12 is a side cross-sectional view of the second overpack configuration, taken along the line 12—12 of FIG. 11.
Figure 13:
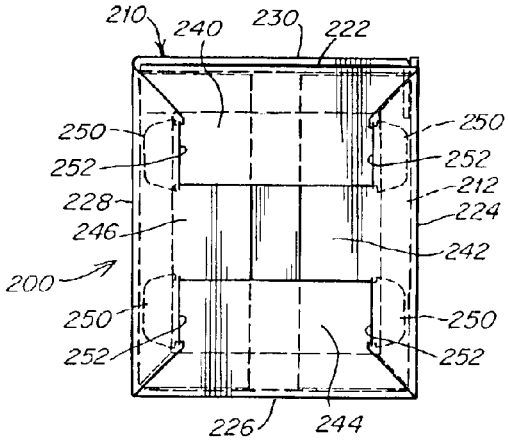
FIG. 13 is an end view of the closed end of the overpack carton as seen along arrows 13—13 of FIG. 12.

Latching panel 30 is then folded along fold line 56 such that lever panel 60 angled relative to base panel 62, thereby extending first tabs 40 toward first slots 50, as shown in FIG. 10B. First tabs 40 are fixed to lever panel 60, so that first tabs 40 are aligned with first slots 50 in side panel 22 when level panel 60 is an upright position. Then, first tabs 40 are inserted into first slots 50, as illustrated in FIGS. 10B and 10D, and lever panel 60 is pivoted about fold line 56. The pivoting movement of tab 40 in slot 50 causes latching panel 30 to move to the right in FIG. 10D relative to side panel 22, thereby tightening packing strap 20 around primary shipping case 12 and compressing cushion strips 80, 82 and 84, at least slightly. Lever panel 60 is pivoted about fold line 56 such that second tabs 42 can be inserted and locked in second slots 52, as illustrated in FIGS. 10C and 10D. The overpack carton 10 is thus securely latched around primary shipping case 12 with cushion strips 80, 82 and 84 at least slightly compressed to securely hold primary shipping case 12. The overpack carton 10 is easily removed from primary shipping case 12 by reversing the above process, and can be reused if desired.

It will be understood that a variety of different latching elements may be utilized within the scope of the invention. The latching elements may, but are not required to be, integrally formed on packing strap 20. One or more sets of latching elements may be utilized, depending on the size of the overpack carton and the required latching integrity. Alternatively, tape or bands 180, shown in phantom in FIG. 1, may be used to close overpack carton 10.

A second overpack configuration in accordance with the invention is shown in FIGS. 11–14B. The configuration of FIGS. 11–14B utilizes end cap overpack cartons 200 and 202 for packing of primary shipping case 12. The end cap overpack cartons 200 and 202 are wrapped around opposite end portions of primary shipping case 12 and provide protection for the ends of primary shipping case 12.

Figure 14A:
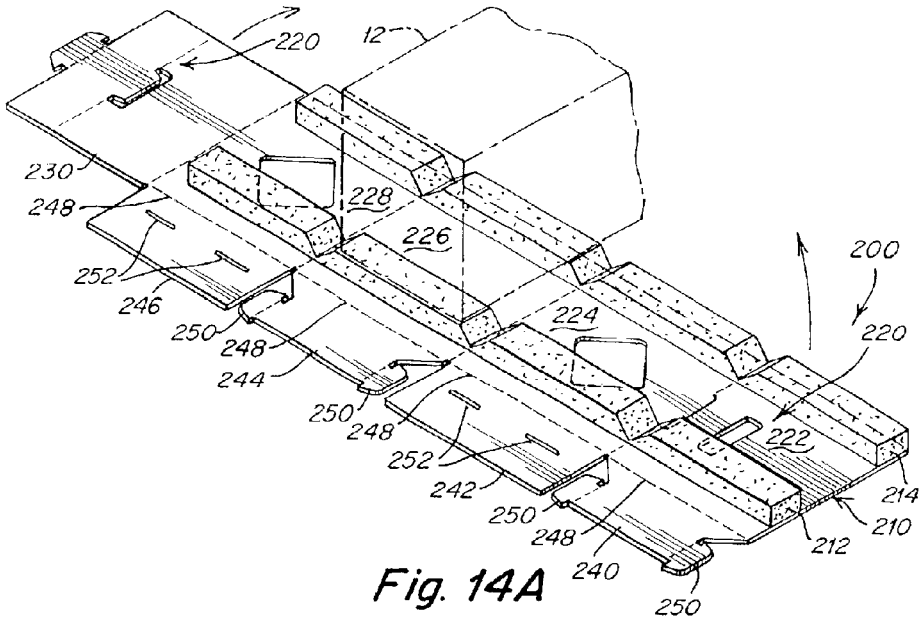
FIG. 14A is a perspective view that illustrates an initial step of a method for packing a primary shipping case using the end cap overpack carton of FIGS. 11–13.

Overpack carton 200 includes a packing strap 210, having four side panels and a latching panel, cushion strips 212 and 214 and latching elements 220. The configuration of packing strap 210, cushion strips 214 and latching elements 220 may be similar to the overpack cartons shown and described above, with appropriate adjustment for the smaller width of the packing strap. As shown in FIG. 14A, packing strap 210 includes a first side panel 222, a second side panel 224, a third side panel 226, a fourth side panel 228 and a latching panel 230. The overpack carton 202 at the opposite end of primary shipping case 12 may have the same configuration as overpack carton 200.

Figure 14B:
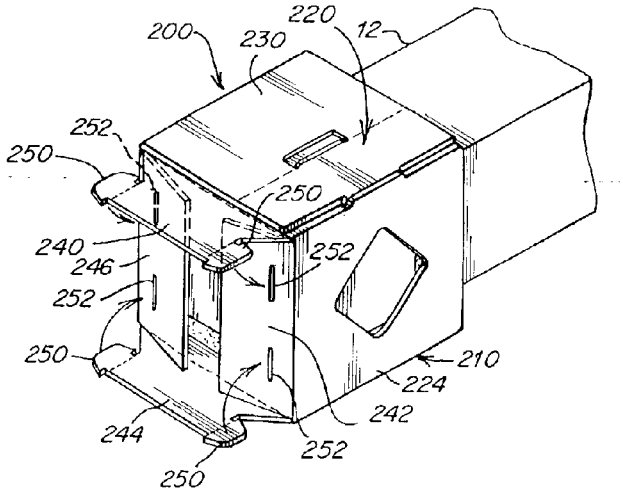
FIG. 14B is a perspective view of the packing method wherein the end flaps are latched in place.

The overpack carton 200 further includes end flaps 240, 242, 244 and 246 connected along fold lines 248 to side panels 222, 224, 226 and 228, respectively. End panels 240 and 244 are provided with tabs 250, and end panels 242 and 246 are provided with slots 252, as best shown in FIG. 14A. When the packing strap 210 is wrapped around primary shipping case 12, end flaps 240, 242, 244 and 246 are folded inwardly as shown in FIG. 14B and tabs 250 are inserted into the respective slots 252 to secure end flaps 240, 242, 244 and 246 in positions which protect the end of primary shipping case 12.

It will be understood that the end flaps 240, 242, 244 and 246 are not required in the end cap overpack carton and that the overpack carton 200 may have an open end of the type shown in FIG. 1. Furthermore, the full-length overpack carton shown in FIGS. 1–5B and described above may utilize end flaps if desired. The end flaps may partially or fully enclose the end of the overpack carton.

Figure 15A:
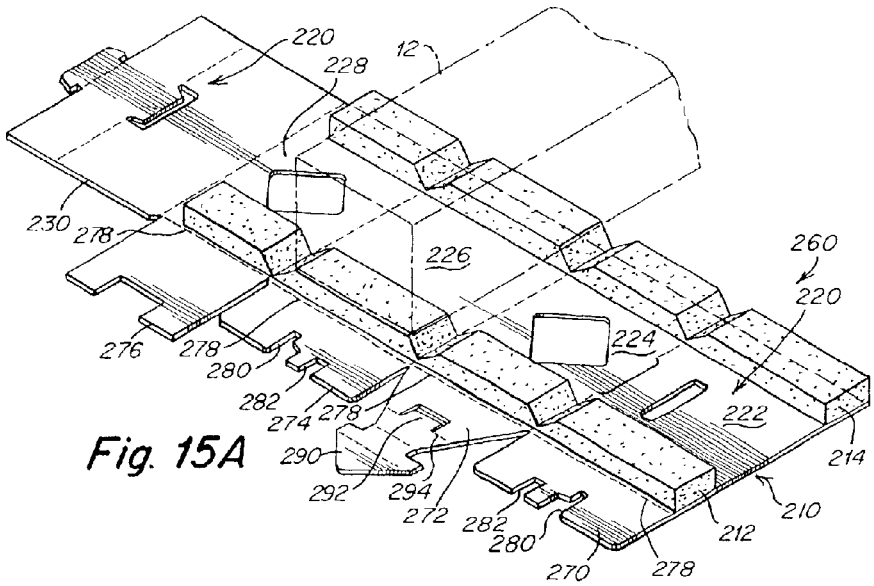
FIG. 15A is a perspective view of another embodiment of the end cap overpack carton.
Figure 15B:
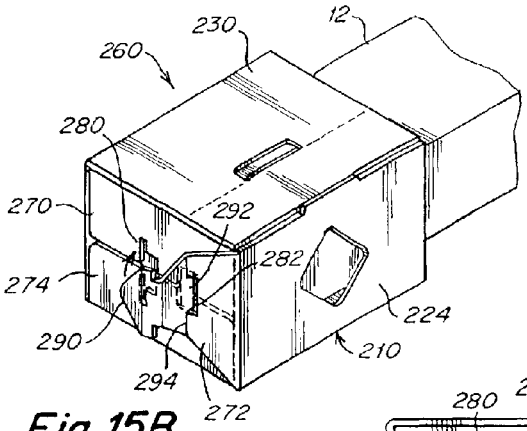
FIG. 15B is a perspective view of the overpack carton of FIG. 15A, illustrating latching of the end flaps.
Figure 15C:
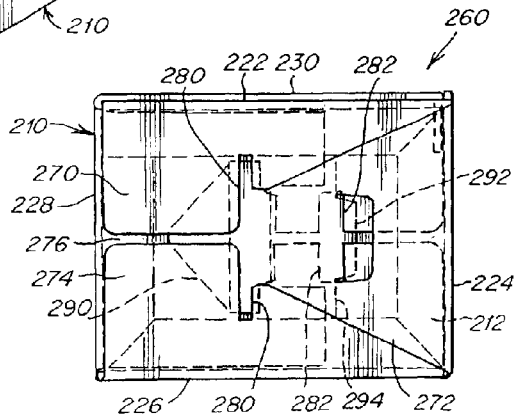
FIG. 15C is an end view of the overpack carton of FIGS. 15A and 15B.

A second configuration of the end cap overpack carton is shown in FIGS. 15A–15C. Like elements in FIGS. 11–15C have the same reference numerals. An end cap overpack carton 260 is similar to overpack carton 200 shown in FIGS. 11–14B, except for the configuration of the end flaps. End flaps 270, 272, 274 and 276 are connected along fold lines 278 to side panels 222, 224, 226 and 228, respectively. End flaps 270 and 274 each have an arrangement of notches 280 and 282 that define slots when the end flaps 270 and 274 are folded together, as shown in FIG. 15C. End flap 272 includes a tab 290 and a tab 292 and is provided with a fold line 294. End flap 272 is folded along fold line 294 such that tab 292 may be inserted in the slot defined by notches 282. The flap is then pivoted about fold line 294 such that tab 290 may be inserted in the slot defined by notches 280. This arrangement provides latching of end flaps 270, 272, 274 and 276 and some compression of cushion strip 212. The latching arrangement for the end flaps shown in FIGS. 15A-15C is similar to the latching arrangement for the side panels on the overpack carton as described above.

Figure 16:
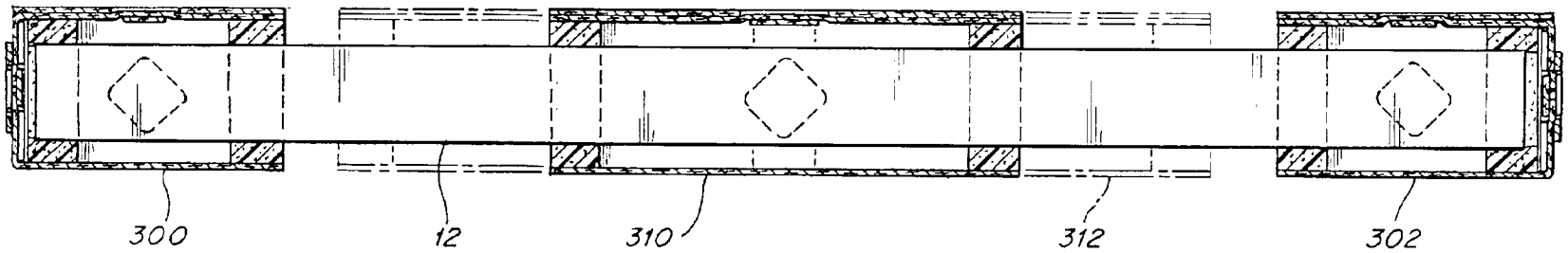
FIG. 16 is a cross-sectional side view of a third overpack configuration utilizing two end cap overpack cartons and an intermediate overpack carton.

A third overpack configuration in accordance with the invention is shown in FIG. 16. The overpack configuration of FIG. 16 includes end cap overpack cartons 300 and 302 latched around opposite end portions of primary shipping case 12 and an intermediate overpack carton 310 latched around an intermediate portion of primary shipping case 12. The end cap overpack cartons 300 and 302 may be constructed as described above in connection with FIGS. 11–14B or FIGS. 15A–15C. Intermediate overpack carton 310 may be a short version of the full-length overpack carton shown in FIGS. 1–5B and described above. It will be understood that both the end cap overpack cartons 300 and 302 and the intermediate overpack carton 310 may have any convenient width. A wider intermediate overpack carton 312 is shown in phantom is FIG. 16. The width of the overpack cartons depend on the length of the primary shipping case and the required coverage of primary shipping case 12 by the combined overpack cartons.

The overpack cartons described above have been designed for packaging an elongated, rectangular primary shipping case. It will be understood that the overpack carton can be configured for packaging a primary shipping case of any size, shape and form factor. For example, the primary shipping case is not necessarily elongated and is not necessarily rectangular. Furthermore, the primary shipping case may have any number of sides.

While there have been shown and described what are at present considered the preferred embodiments of the present invention, it will be obvious to those skilled in the art that various changes and modifications may be made therein without departing from the scope of the invention as defined by the appended claims.

What is claimed:

1. A method for packing a primary shipping case, comprising the steps of:

providing a cushioned packing strap having one or more cushion strips and latching elements, and having a plurality of panels connected along fold lines;

wrapping the packing strap around at least a portion of the primary shipping case by folding the packing strap along said fold lines; and interengaging the latching elements so that the packing strap is latched around at least a portion of the primary shipping case with said one or more cushion strips facing the primary shipping case and at least slightly compressed to secure the packing strap on the primary shipping case, said packing strap having at least one open end when latched around the primary shipping case.

2. A method as defined in claim 1, wherein the step of providing a cushioned packing strap comprises providing a packing strap comprising interconnected first, second, third and fourth side panels, and a latching panel connected to the fourth side panel.

3. A method as defined in claim 1, wherein the step of providing a cushioned packing strap having latching elements comprises providing a packing strap having integral latching elements.

4. A method as defined in claim 1, wherein the step of providing a cushioned packing strap comprises providing a packing strap having end flaps for enclosing at least one end of the primary shipping case.

5. A method as defined in claim 1, wherein the step of interengaging the latching elements comprises tensioning the packing strap on the primary shipping case.

6. A method for packing a primary case, comprising:

providing a packing strap having at least one open end in the absence of the primary shipping case, having at least one cushion affixed to the packing strap, and having a plurality of panels connected along fold lines;

wrapping the packing strap around at least a portion of the primary shipping case by folding the packing strap along said fold lines; and securing the packing strap on the primary shipping case with the cushion at least slightly compressed.

7. A method as defined in claim 6, wherein securing the packing strap on the primary shipping case comprises interengaging latching elements on the packing strap.

8. A method as defined in claim 6, wherein securing the packing strap on the primary shipping case comprises interengaging latching elements integrally formed on the packing strap.

9. A method as defined in claim 6, wherein securing the packing strap on the primary shipping case comprises closing the packing strap around at least part of the primary shipping case with a closure device.

10. A method as defined in claim 6, wherein securing the packing strap on the primary shipping case comprises closing the packing strap around at least part of the primary shipping case with one or more bands.

11. A method as defined in claim 6, wherein securing the packing strap on the primary shipping case comprises closing the packing strap around at least part of the primary shipping case with tape.

12. A method as defined in claim 6, wherein securing the packing strap on the primary shipping case comprises tensioning the packing strap around the primary shipping case.

13. A method as defined in claim 6, wherein wrapping the packing strap around at least a portion of the primary shipping case comprises securing one or more end flaps of the packing strap around the primary shipping case.

14. A method as defined in claim 6, wherein providing a packing strap comprises providing end caps for securing to opposite ends of the primary shipping case.

15. A method as defined in claim 6, wherein providing a packing strap comprises providing a packing strap having open ends when secured on the primary shipping case.

16. A method as defined in claim 6, wherein providing a packing strap comprises providing a packing strap having ends that extend beyond the primary shipping case when the packing strap is secured on the primary shipping case.

17. A method as defined in claim 6, wherein providing a packing strap comprises providing a packing strap that covers the full length of the primary shipping case.

18. A method as defined in claim 6, wherein providing a packing strap comprises providing a packing strap that covers less than the full length of the primary shipping case.

19. A method for packing a primary shipping case having a first end and second end, comprising:

providing first and second packing straps and first and second cushions affixed to the first and second packing straps, respectively;

wrapping the first and second packing straps around the primary shipping case; and securing the first and second packing straps on the primary shipping case with the first and second cushions at least slightly compressed.

20. A method as defined in claim 19, wherein wrapping the first and second packing straps around the primary shipping case comprises wrapping the first and second packing straps around the first and second ends, respectively, of the primary shipping case.

21. A method as defined in claim 19, wherein securing the first and second packing straps on the primary shipping case comprises interengaging latching elements on each of the first and second packing straps.

22. A method as defined in claim 19, wherein securing the first and second packing straps on the primary shipping case comprises interengaging latching elements integrally formed on the first and second packing straps.

23. A method as defined in claim 19, wherein securing the first and second packing straps on the primary shipping case comprises securing around the primary shipping case end flaps on each of the first and second packing straps.

24. A method as defined in claim 19, wherein wrapping the first and second packing straps around the primary shipping cage comprises folding panels of the first and second packing straps around the primary shipping case.

25. A method as defined in claim 19, wherein securing the first and second packing straps on the primary shipping case comprises tensioning the first and second packing straps around the primary shipping case.

26. A method as defined in claim 19, further comprising:

providing a third packing strap and a third cushion affixed to the third packing strap;

wrapping the third packing strap around the primary shipping case between the first and second packing straps; and securing the third packing strap on the primary shipping case with the third cushion at least slightly compressed.

27. A method for packing a primary shipping case, comprising:

providing a packing strap having at least one cushion affixed thereto and a plurality of panels connected along fold lines;

wrapping the packing strap around the primary shipping case by folding the packing strap along said fold lines; and securing the packing strap on the primary shipping case with the cushion at least slightly compressed and with the primary shipping case at least partially exposed.

* * * * *